US012649596B2

(12) United States Patent
Ilgenfritz et al.

(10) Patent No.: US 12,649,596 B2
(45) Date of Patent: Jun. 9, 2026

(54) DEVICE FOR CLOSING PHARMACEUTICAL CONTAINERS

(71) Applicant: Syntegon Technology GmbH, Waiblingen (DE)

(72) Inventors: Markus Ilgenfritz, Feuchtwangen (DE); Ulrich Krauß, Ilshofen (DE); Stefan Nagler, Unterschneidheim (DE)

(73) Assignee: Syntegon Technology GmbH, Waiblingen (DE)

( * ) Notice: Subject to any disclaimer, the term of this patent is extended or adjusted under 35 U.S.C. 154(b) by 331 days.

(21) Appl. No.: 18/253,338

(22) PCT Filed: Nov. 19, 2021

(86) PCT No.: PCT/EP2021/082235
§ 371 (c)(1),
(2) Date: May 17, 2023

(87) PCT Pub. No.: WO2022/112106
PCT Pub. Date: Jun. 2, 2022

(65) Prior Publication Data

US 2024/0002085 A1 Jan. 4, 2024

(30) Foreign Application Priority Data

Nov. 24, 2020 (DE) ..... 10 2020 131 098.6

(51) Int. Cl.
*B65B 7/28* (2006.01)
*B65B 57/02* (2006.01)

(52) U.S. Cl.
CPC ..... *B65B 7/2821* (2013.01); *B65B 57/02* (2013.01)

(58) Field of Classification Search
None
See application file for complete search history.

(56) References Cited

U.S. PATENT DOCUMENTS 5,239,136 A * 8/1993 Chiari ..... B67B 1/04 177/50
2011/0030316 A1 2/2011 Blumenstock et al.
(Continued)

FOREIGN PATENT DOCUMENTS

CN 102015456 A 4/2011
CN 104602738 A 5/2015
(Continued)

OTHER PUBLICATIONS

German Patent Office Action for Application No. 102020131098.6 dated Aug. 10, 2021 (8 pages including statement of relevance).
(Continued)

*Primary Examiner* — Tanzim Imam
(74) *Attorney, Agent, or Firm* — Michael Best & Friedrich LLP

(57) ABSTRACT

The invention relates to a device (10) for closing pharmaceutical containers (18) by means of closures (22), having a first holding device (12) for receiving at least one pharmaceutical container (18), a second holding device (14) for receiving at least one closure (22) for closing an opening (24) of the pharmaceutical container (18), wherein the two holding devices (12, 14) are mutually alignable, or are mutually aligned, in such a way that the closure (22) and the opening (24) of the container (18) are aligned with one another, wherein a plunger (34) and a counter element (40) are provided, wherein the plunger (34) and/or the counter element (40), by means of a drive device (36), can be driven and, relative to one another, moved, wherein, when the plunger (34) and the counter element (40) are moved towards one another when the drive device (36, 42) is driven, the plunger (34) acts on the closure (22) or on the container (18) in such a way that the closure (22) can come into contact with the container (18) and, in order to close the opening (24) of the container (18), can be pressed onto the
(Continued)

container (18) by the cooperation of the plunger (34) and the counter element (40), wherein a force sensor (44) is provided, by means of which a force applied by the closure plunger (34) when the closure (22) is pressed onto the container (18) can be detected.

18 Claims, 1 Drawing Sheet

(56) References Cited

U.S. PATENT DOCUMENTS

| | | | | |
|---|---|---|---|---|
| 2014/0056784 | A1 | 2/2014 | Simons et al. | |
| 2014/0069062 | A1* | 3/2014 | Bogle | B65B 7/2821 53/287 |
| 2017/0183113 | A1 | 6/2017 | Deutschle et al. | |
| 2018/0162572 | A1 | 6/2018 | Trilli et al. | |
| 2018/0370665 | A1 | 12/2018 | Broadbent et al. | |
| 2020/0377242 | A1 | 12/2020 | Dinka et al. | |
| 2022/0055881 | A1* | 2/2022 | Krulitsch | B67C 7/0006 |
| 2022/0212818 | A1 | 7/2022 | Schwandt et al. | |

FOREIGN PATENT DOCUMENTS

| | | | | |
|---|---|---|---|---|
| DE | 4442035 | A1 | 5/1996 | |
| DE | 102008001288 | A1 | 10/2009 | |
| DE | 102018124874 | A1 * | 4/2020 | B67C 7/00 |
| DE | 102019207282 | A1 | 11/2020 | |
| EP | 0892918 | B1 | 5/2003 | |
| EP | 2949353 | A2 | 12/2015 | |
| IT | 201900001875 | A1 * | 8/2020 | B67B 1/04 |
| WO | 2019126827 | A1 | 6/2019 | |

OTHER PUBLICATIONS

Translation of International Search Report for Application No. PCT/EP2021/082235 dated Feb. 23, 2022 (2 pages).

Chinese Patent Office Action for Application No. 202180078758.5 dated Aug. 16, 2025 (18 pages including English machine translation).

German Patent Office Communication for Application No. 102020131098.6 dated Jan. 7, 2026 (6 pages including English machine translation).

* cited by examiner

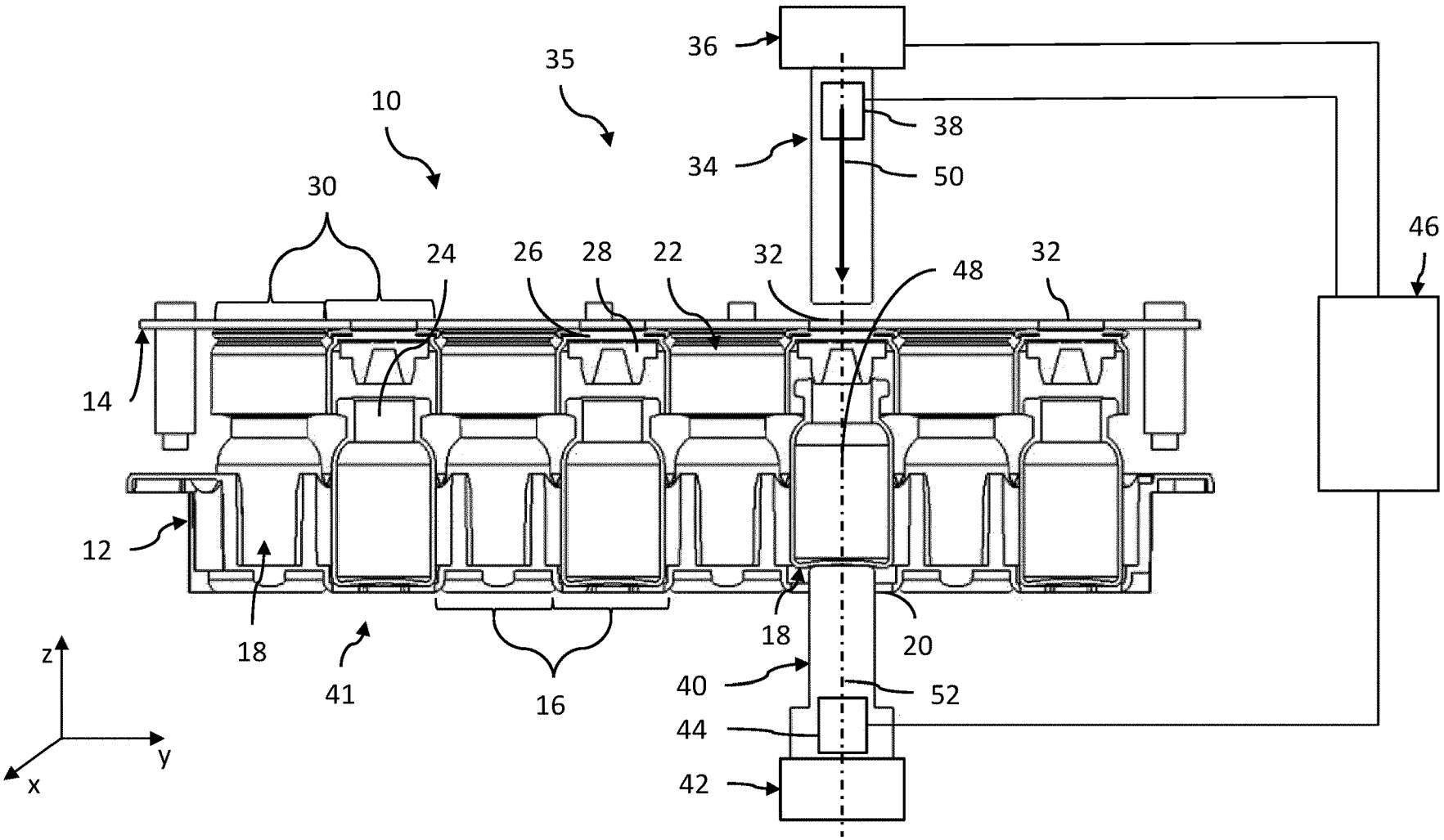
46
32
38
50
48
20
52
36
34
32
18
40
44
42
22
35
28
26
16
24
10
30
41
18
14
12
z
y
x

DEVICE FOR CLOSING PHARMACEUTICAL CONTAINERS

BACKGROUND

The present invention relates to a device for closing pharmaceutical containers by means of closures. In addition, the invention relates to a method for closing pharmaceutical containers by means of closures.

Devices or methods of the type mentioned at the outset are known from the prior art—for example, from US 2018/0370665 A1. Simultaneously pressing several closures onto several pharmaceutical containers is thereby possible.

However, in such a path-controlled closing of several pharmaceutical containers with closures by means of a plate, it is disadvantageous that, due to manufacturing tolerances in the height of the pharmaceutical containers, glass breakage, damaged closures, or incorrectly closed containers can occur. A reliable closing of the containers is thus not ensured to a sufficient extent. As such, there is a need for optimization.

SUMMARY

The object of the invention is to provide an improved device and an improved method. It is particularly desirable to monitor the closing process of the pharmaceutical containers with simple structural means.

The device has a first holding device for receiving at least one pharmaceutical container. A second holding device is provided for receiving at least one closure for closing an opening of the pharmaceutical container. The two holding devices are mutually alignable or aligned with one another in such a way that the closure and the opening of the pharmaceutical container are aligned with one another.

A (first) plunger and a counter element are provided, wherein the plunger and/or the counter element (40), by means of a drive device, can be driven and, relative to one another, moved.

If the plunger and the counter element are moved towards one another when the drive device is driven, the plunger acts on the closure or on the container in such a way that the closure comes into contact with the container and can, for the purpose of closing the opening of the container, be pressed onto the container by the interaction of the plunger and counter element.

The device is characterized in that a force sensor is provided. The force sensor can detect a force applied by the interaction between the plunger and the counter element when the closure is pressed onto the pharmaceutical container.

The device makes it possible to monitor a closing process of pharmaceutical containers. By monitoring the closing process by means of detecting the force or a force curve, it can be determined if a closure is lost during its provision (if the closure does not reach the pharmaceutical container to be closed). In addition, it can be determined on the basis of the detected force or on the basis of the detected force curve whether the closing process is carried out correctly. In the simplest case (only one plunger and only one counter element present), only one pharmaceutical container is closed at a time. If several pharmaceutical containers are to be closed, this can take place in succession.

The pharmaceutical container may be a vial (injection vial), a syringe, or a carpule.

Suitable closures are provided for the various pharmaceutical containers. The closures can be press caps (caps with integrated rubber plugs), rubber plugs with aluminum crimp caps, vial plugs, syringe plugs, or carpules.

An alignment of the closure and the opening of the pharmaceutical container means an arrangement such that the closure fits onto the container, so that the opening can be closed. For an alignment, it can be provided that the central longitudinal directions of the closure and the pharmaceutical container coincide.

Furthermore, the plunger and/or the counter element can be displaced by means of the drive device in particular along the central longitudinal axis of the plunger or the counter element. By means of the drive device, the plunger, the counter element, or the plunger and the counter element can be designed to be movable.

For a structurally simple configuration, the counter element can be designed to be stationary, and the plunger can be moved relative to the counter element. If the plunger is moved towards the counter element, and if at least one closure and at least one container are arranged between the plunger and the counter element, the closure can be pressed onto the container.

The plunger can be arranged along the direction of gravity both below and above the container and the closure. If the plunger is arranged above the container and the closure (counter element below), the plunger can act on the closure, for example, and thus press the closure onto the container. If the plunger is arranged below the container and the closure (counter element above), the plunger can act on the container and thus press the closure onto the container by acting on the container. Other embodiments, e.g., with a drivable counter element, are also conceivable.

The (first) plunger can—particularly if the closing process of the container by the closure proceeds from the (first) plunger—be referred to as a closure plunger.

The central longitudinal axis of the plunger or the counter element can be the z-axis, which forms the normal vector of an x-y plane.

The x-y plane can in particular be oriented orthogonally to the central longitudinal axis of the counter element.

The force sensor can advantageously be arranged on the plunger or on the counter element. This allows flexible positioning of the force sensor. As such, the force applied to the container can be applied directly on the (first) plunger or on the counter element which apply the force.

It can be advantageous if the plunger and the counter element are designed to be movable, relative to the first holding device, along a plane which is oriented orthogonally to the central longitudinal axis of the counter element. Because the plunger and the counter element are movable relative to the first holding device, the plunger and the counter element can be mutually aligned, relative to the first holding device, along the plane. If the device is being equipped with new pharmaceutical containers and closures, it is then also advantageous if several pharmaceutical containers and/or closures are arranged in the holding devices. The travel range of the plunger and the counter element is dimensioned—in particular, if the device has only one plunger and only one counter element—in such a way that all pharmaceutical containers and/or closures arranged in the holding devices can be reached.

In other words, the central longitudinal axis of the counter element is the normal vector of a plane. The plane is an X-Y plane, i.e., holding devices, plungers, and counter elements are displaceable relative to one another along the X-axis and along the Y-axis. The drive device of the plunger can be configured such that the plunger is movable not only along its central longitudinal axis, but also in a plane orthogonal thereto.

Expediently, the counter element and/or the first holding device can each be movable by means of a further drive device. The counter element and/or the first holding device can each be movable along the central longitudinal axis of the counter element or along the central longitudinal axis of the counter element and along a plane oriented orthogonally to the central longitudinal axis.

The second holding device—if it is designed separately from the plunger and/or from the counter element—can be moved manually or by means of a drivable handling device from a provision position to the first holding device, in order to provide one or more closures on the pharmaceutical containers. By using a handling device, it can be ensured that no contamination of the pharmaceutical containers takes place, and a precise alignment of the second holding device on the first holding device can be achieved. The drivable handling device can be designed as a robot, for example.

The device can have a controller for actuating the drive device—for example, the drive device of the plunger. In this case, the controller is configured for actuating the drive device in such a way that the closure is pressed onto the pharmaceutical container by means of a force control or a force/displacement control. Force, or force and displacement, can be detected and thus monitored during the pressing process. The controller can be electrically or electronically coupled to the force sensor, i.e., an output signal of the force sensor enters the controller as an input signal. A path sensor can be provided—in particular, on the closure plunger—the output signal of which is input into the controller as a further input signal. The controller can also be coupled to further drive devices of the first holding device or the counter element in order to actuate them.

Alternatively, a resilient element can be provided, by means of which the force applied during the closing can be controlled. The applied force for the closing process can thus be controlled via a resilient element. In this case, a controller can be omitted.

In an advantageous manner, the first holding device and/or the second holding device can each be designed as a holding portion which is fastened to the plunger or to the counter element. As such, the holding devices are each formed directly on the plunger or counter element, or integrated therein. As a result, a closure or a container can be inserted directly into an associated holding device and/or coupled thereto, wherein the holding device is fastened to the plunger or to the counter element. This allows a—structurally—particularly simple configuration of the device—for example, for the individual closing of a container with a closure.

As already indicated above, the holding devices can alternatively be designed to be separate from the plunger or from the counter element. In the context of such a separate embodiment, it is conceivable that the plunger, when the drive device is driven, be able to pass through a passage, formed in the second holding device, in order to come into contact with the closure. The counter element can, if it is designed as a further plunger, pass through a further passage, formed in the first holding device, in order to come into contact with the container on the end, facing away from the opening, of the container. The plunger and/or the counter element can thus act directly on the closure or the container. This contributes to a precise closing process.

Advantageously, the first holding device and the counter element (in the case of a separate configuration of the holding devices) can be designed to be displaceable relative to one another along a central longitudinal axis of the counter element. As a result, a pharmaceutical container arranged in the first holding device can be raised relative to the holding device. As such, the pharmaceutical container can, for a force measurement, be raised shortly before or during a closing process. This contributes to a precise force measurement, since the pressing force or closing force of the closure on the container is applied into the plunger and/or the counter element, and thus directly into the force sensor, and not into the first holding device.

The first holding device and/or the second holding device can advantageously have several holding portions. A pharmaceutical container can be received in each holding portion of the first holding device, and a closure can be received in each holding portion of the second holding device. Consequently, the holding devices can each be equipped with several pharmaceutical containers and/or with several closures. This promotes a time-efficient closing of the pharmaceutical containers, since it is not necessary to refill after each closing. The holding portions in the holding devices can each be arranged adjacent to one another in a row or column. An arrangement in several rows and columns is also conceivable in each case. The holding devices can each be a nest for receiving a plurality of pharmaceutical containers and/or closures.

Expediently, the counter element can be designed as an optionally stationary plate or as a further plunger (counter plunger). An embodiment of the counter element as a stationary plate contributes to a structurally simple design of the device. An embodiment of the counter element as a further plunger contributes to a targeted actuation of individual containers or closures. The further plunger can be fixed or, optionally, movable.

Specifically, the device can have several plungers and several counter elements—in particular, several further plungers with a force sensor. Several pharmaceutical containers can thus be closed in parallel and/or simultaneously, and monitored by means of a force sensor during the closing process. Consequently, a smaller throughput time results for a defined number of pharmaceutical containers than in an embodiment of the device having only one closure plunger and one counter plunger.

The method for closing pharmaceutical containers, in which in particular a device as described above can be used, comprises at least the following steps: provision, alignment, and pressing on.

In the first step, at least one pharmaceutical container and at least one closure for closing an opening of the pharmaceutical container are provided. Such a provision can take place, for example, by means of a first holding device for receiving at least one pharmaceutical container and/or by means of a second holding device for receiving at least one closure for closing an opening of the pharmaceutical container, as described above.

The pharmaceutical container and the closure are subsequently aligned relative to one another so that the closure and the opening of the pharmaceutical container are aligned with one another. In other words, the container and the closure are intended to be aligned with one another such that the closure fits onto the container. The pharmaceutical container and the closure can in particular be aligned such that the central longitudinal directions of the closure and pharmaceutical container coincide. This can take place, for example, by driving drive devices of the first holding device and/or of the counter element and/or of the (first) plunger.

Subsequently, the closure is pressed onto the pharmaceutical container in order to close the opening of the pharmaceutical container.

The closing process is monitored. For this purpose, when the closure is pressed on, the force applied to the pharmaceutical container is detected—in particular, in the form of a force curve or a force/displacement curve.

In an advantageous manner, the closure can be pressed onto the pharmaceutical container in a force-controlled or force/displacement-controlled manner. This facilitates particularly precise pressing of the closure onto the container.

The closure can be pressed on by means of a drivable plunger. The plunger can be situated on the side of the pharmaceutical container on which its opening is arranged. The detection of the force applied to the pharmaceutical container can take place by means of a force sensor, which can be arranged on the plunger or on a counter element, which is arranged on a second side, facing away from the first side, of the container—for example, on the side, facing away from the opening, of the pharmaceutical container. As a result, the force applied to the closure by the plunger can be detected by means of a force sensor.

Advantageously, the raising of the pharmaceutical container can be shortly before or when the closure is pressed on. The pharmaceutical container can be raised in particular by moving the counter element and a first holding device that receives the pharmaceutical container. In this case, the counter element and a first holding device move relative to one another along the central longitudinal axis of the counter element.

Expediently, the method can provide that, if, when the closure is pressed onto the pharmaceutical container, no force, or no sufficiently high force, is detected, then the provision, alignment, and/or pressing of the closure onto the pharmaceutical container be repeated. Alternatively, the pharmaceutical container and/or the closure can be recognized and sorted out as a "reject container." For example, the controller can be coupled to a force sensor and/or a path sensor which enter into the controller as input signals, as described above. The controller can control the drive device of the plunger and, optionally, also further drive devices of the counter element and the holding device accordingly.

If, for example, a sufficiently high force or a corresponding force curve is detected by means of the force sensor, the pharmaceutical container is recognized as reliably closed. If no force and/or force curve can be detected, or is/are not sufficiently high, the pharmaceutical containers can be reprocessed or sorted out. Likewise, in the case of closures formed in multiple parts (for example, rubber plugs and aluminum crimp cap), a detection can be made when a second component of the closure is applied, to determine whether the first component of the closure is still present and/or is seated on the opening.

The measures described in connection with the device or to be explained below can serve for further embodiment of the method.

BRIEF DESCRIPTION OF THE DRAWINGS

The invention is explained in more detail below with reference to the FIGURES, wherein equivalent or functionally equivalent elements are provided with identical reference signs—possibly, however, only once. In the drawings:

FIG. 1 is a schematic, partially cutaway, lateral view of an embodiment of a device for closing pharmaceutical containers.

DETAILED DESCRIPTION

FIG. 1 shows a device for closing pharmaceutical containers, wherein the device is denoted as a whole by the reference numeral 10.

The device 10 has a first holding device 12 and a second holding device 14.

The first holding device 12 has several holding portions 16. The holding portions 16 serve to receive pharmaceutical containers 18. Each pharmaceutical container 18 has an opening 24. A passage 20 is formed in each holding portion 16 opposite the opening 24 of the pharmaceutical containers 18 on the first holding device 12.

The second holding device 14 serves to receive at least one closure 22 for closing an opening 24 of the pharmaceutical container 18. The closure 22 comprises a cap 26 and a rubber plug 28. In FIG. 1, the second holding device 14 has several holding portions 30 for closures 22. At each of the holding portions 30, adjacent to the closures 22, a passage 32 is formed on the second holding devices 14.

The device of FIG. 1 comprises a first plunger 34 with a drive device 36 and with a path sensor 38 arranged in this case, by way of example, on the plunger 34. In the example, the plunger 34 is referred to below as a closure plunger 34. In the example, the closure plunger 34 is situated on a side 35 of the pharmaceutical container 18 which faces the opening 24 (arrangement of the closure plunger 34 along the direction of gravity above the container 18 and the closure 22).

Furthermore, the device has a counter element 40 with a drive device 42. In the example, the counter element 40 is designed as a further plunger or as a counter plunger 40. In addition, a force sensor 44 is provided, and is arranged on the counter plunger 40 in the example. In the example, the counter plunger 40 is arranged on the side 41, facing away from the opening 24, of the pharmaceutical container 18 (arrangement of the counter plunger 40 in the direction of gravity below the container 18 and the closure 22).

A controller 46 is provided for actuating the drive unit 36. The controller 46 is electrically connected to the force sensor 44 and the path sensor 38. The output signals of path sensor 38 and force sensor 44 accordingly enter the controller 46 as input signals.

In the example, the first and second holding devices 12, 14 are each designed separately from the closure plunger 34 and/or from the counter plunger 40. The first and second holding devices 12, 14 are aligned with one another so that the closure 22 and the opening 24 of the pharmaceutical container 18 are aligned with one another.

The closure plunger 34 and the counter plunger 40 are designed to be displaceable, relative to the first holding device 12, along an x-y plane. The x-y plane is oriented orthogonally to the central longitudinal axis 52 of the counter plunger 40. The central longitudinal axis 50 of the closure plunger 34 forms a z-axis. The closure plunger 34 and the counter plunger 40 can be moved in such a way that they reach each position of a pharmaceutical container 18 to be closed. In this case, the closure plunger 34 and the counter plunger 40 are aligned on the center axis 48 of the pharmaceutical container 18 so that the center axes 48 of the pharmaceutical container 18, the center axis 50 of the closure plunger, and the center axis 52 of the counter plunger 40 are aligned with one another.

The counter plunger 40 can pass through the passage 20 when the drive unit 42 is driven, and can come into contact with the pharmaceutical container 18. The pharmaceutical container 18 is raised by the counter plunger 40 along its central longitudinal axis 48, relative to the first holding device 12.

The closure plunger 34, when the drive unit 36 is driven, can pass through the passage 32 in the second holding device 14, and accordingly come into contact with the closure 22 and press it onto the pharmaceutical container 18 for the purpose of closing the opening 24 of the pharmaceutical container.

The device 10 comprises a force/displacement-controlled monitoring of the closing process.

In this case, the force sensor 44 of the counter plunger 40 detects a force applied by the closure plunger 34 when the closure 22 is pressed onto the pharmaceutical container 18. The force is detected on or via the container 18.

The path sensor 38 of the closure plunger 34 detects the displacement path of the closure plunger 34 when the closure 22 is pressed onto the pharmaceutical container 18.

The controller 46 is electrically coupled to the force sensor 44 and the path sensor 38, so that the output signals of the sensors enter into the controller 46. In this case, the controller 46 is additionally coupled to the drive devices 36, 42 of the closure plunger and of the counter plunger, and controls them.

The invention claimed is:

1. A device for closing pharmaceutical containers via closures, the device having:

a first holding device for receiving at least one pharmaceutical container, a second holding device for receiving at least one closure for closing an opening of the at least one pharmaceutical container, wherein the first and second holding devices are mutually alignable, or are mutually aligned, in such a way that the at least one closure and the opening of the at least one pharmaceutical container are aligned with one another, wherein a plunger and a counter element are provided, wherein the plunger and/or the counter element can be driven and moved relative to one another by a drive device, wherein, when the plunger and the counter element are moved towards one another when the drive device is driven, the plunger acts on the at least one closure or on the at least one pharmaceutical container in such a way that the at least one closure comes into contact with the at least one pharmaceutical container and, in order to close the opening of the at least one pharmaceutical container, is pressed onto the at least one pharmaceutical container by cooperation of the plunger and the counter element, wherein a force sensor is provided, by which force sensor a force applied by the cooperation of the plunger and the counter element when the at least one closure is pressed onto the at least one pharmaceutical container can be detected, wherein the plunger and the counter element are configured to be movable, relative to the first holding device, along a plane, and wherein the plane is oriented orthogonally relative to a central longitudinal axis of the counter element.

2. The device according to claim 1, wherein the force sensor is arranged on the plunger or on the counter element.

3. The device according to claim 1, wherein the counter element and/or the first holding device can be moved by a further drive device along the central longitudinal axis of the counter element, or along both the central longitudinal axis of the counter element- and along the plane oriented orthogonally relative to the central longitudinal axis.

4. The device according to claim 1, wherein a controller is provided for actuating the drive device, the controller being configured to control the drive device in such a way that the at least one closure is pressed onto the at least one pharmaceutical container by a force control or force/displacement control, or wherein a resilient element is provided, by which resilient element the force applied during the closing can be controlled.

5. The device according to claim 1, wherein the first holding device and/or the second holding device are/is configured as a holding portion which is fastened to the plunger or to the counter element.

6. The device according to claim 1, wherein, when the drive device is driven, the plunger can pass through a passage, formed in the second holding device, in order to come into contact with the at least one closure, and/or wherein the counter element can pass through a further passage, formed in the first holding device, in order to come into contact with the at least one pharmaceutical container on an end of the at least one pharmaceutical container facing away from the opening, of the at least one pharmaceutical container.

7. The device according to claim 1, wherein the first holding device and the counter element configured as a further plunger are configured to be displaceable relative to one another along the central longitudinal axis of the counter element, so that a container arranged in the first holding device can be raised relative to the first holding device.

8. The device according to claim 1, wherein the first holding device has several holding portions, in each of which a container can be received, and/or wherein the second holding device has several holding portions, in each of which a closure can be received.

9. The device according to claim 1, wherein the counter element is configured as a plate or as a further plunger.

10. The device according to claim 1, wherein the device has several plungers and several counter elements.

11. The device according to claim 10, wherein the several counter elements are several further plungers with a force sensor.

12. A method for closing pharmaceutical containers via closures using a device according to claim 1, wherein the method comprises the following steps:

providing at least one pharmaceutical container and at least one closure for closing an opening of the at least one pharmaceutical container, aligning the at least one pharmaceutical container and the at least one closure relative to one another, so that the at least one closure and the opening of the at least one pharmaceutical container are aligned with one another, pressing the at least one closure onto the at least one pharmaceutical container in order to close the opening of the at least one pharmaceutical container, wherein, for a purpose of monitoring the closing of the opening, when the at least one closure is pressed on, a force applied to the at least one pharmaceutical container is detected.

13. The method according to claim 12, wherein the at least one closure is pressed onto the at least one pharmaceutical container in a force-controlled or force/displacement-controlled manner, and/or wherein the at least one closure is pressed on by the plunger which is arranged on a first side of the at least one pharmaceutical container, wherein the force applied to the at least one pharmaceutical container is detected by the force sensor, which is arranged on the plunger or on the counter element which is arranged on a second side of the at least one pharmaceutical container facing away from the first side of the at least one pharmaceutical container.

14. The method according to claim 13, wherein the at least one pharmaceutical container, shortly before, or when, the at least one closure is pressed on, is raised along the central longitudinal axis of the counter element.

15. The method according to claim 12, wherein, if, when the at least one closure is pressed onto the at least one pharmaceutical container, no force, or no sufficiently high force, is detected, then the providing, aligning, and/or pressing steps are/is repeated, or wherein the at least one pharmaceutical container and/or the at least one closure are/is sorted out.

16. The method according to claim 12, wherein the force is detected in the form of a force curve or a force/displacement curve.

17. The method according to claim 13, wherein the first side of the at least one pharmaceutical container is a side on which the opening of the at least one pharmaceutical container is arranged, and wherein the second side of the at least one pharmaceutical container is a side facing away from the opening of the at least one pharmaceutical container.

18. The method according to claim 14, wherein the at least one pharmaceutical container is raised by moving the counter element and the first holding device, which receives the at least one pharmaceutical container, relative to one another.

* * * * *